US007272346B2

(12) United States Patent
Ito

(10) Patent No.: US 7,272,346 B2
(45) Date of Patent: Sep. 18, 2007

(54) TONER HOLDING APPARATUS, DEVELOPING APPARATUS, AND IMAGE FORMING APPARATUS

(75) Inventor: Junichi Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 198 days.

(21) Appl. No.: 11/090,285

(22) Filed: Mar. 28, 2005

(65) Prior Publication Data

US 2005/0220498 A1 Oct. 6, 2005

(30) Foreign Application Priority Data

Mar. 31, 2004 (JP) ..... 2004-105616

(51) Int. Cl.
*G03G 15/08* (2006.01)

(52) U.S. Cl. ..... 399/263; 399/258

(58) Field of Classification Search ..... 399/262, 399/263, 120, 358–360
See application file for complete search history.

(56) References Cited

U.S. PATENT DOCUMENTS 6,567,631 B2 * 5/2003 Funayama et al. ..... 399/120
2004/0151523 A1 * 8/2004 Aoki ..... 399/350

FOREIGN PATENT DOCUMENTS

JP 08044179 A * 2/1996
JP 2000-181224 6/2000

* cited by examiner

*Primary Examiner*—David M. Gray
(74) *Attorney, Agent, or Firm*—Rabin & Berdo, P.C.

(57) ABSTRACT

A toner cartridge includes a first chamber and a second chamber divided by a partition wall. A toner moving member has a screw member that rotates to cause the toner in the first chamber to move. An agitating member includes an agitator bar that agitates the toner in the second chamber. The toner moving member and agitating member are operatively coupled so that one of the toner moving member and the agitating member is driven in rotation, the other of the toner moving member and the agitating member also rotates. The toner moving member is a first screw conveyor. The first screw conveyor spans across substantially half a length of the first chamber.

22 Claims, 12 Drawing Sheets

TONER HOLDING APPARATUS, DEVELOPING APPARATUS, AND IMAGE FORMING APPARATUS

BACKGROUND OF THE INVENTION

1. Field of the Invention

The present invention generally relates to a toner cartridge, a developing unit, and an image forming apparatus.

2. Description of the Related Art

FIG. 15 is a side cross-sectional view of a waste toner chamber 105 of a conventional toner cartridge 102 for use in an electrophotographic printer. FIG. 16 is a perspective view of a lid mounted to close one end of the toner cartridge 102 that extends in a longitudinal direction. The toner cartridge 102 includes a fresh toner chamber 104 that holds fresh toner therein and a waste toner chamber 105 that holds waste toner therein. The fresh toner chamber 104 and waste toner chamber 105 extend in their longitudinal directions and are divided by a longitudinally extending partition wall. The fresh toner chamber 104 includes an agitating bar 106 for agitating the fresh toner in the fresh toner chamber 104. The agitating bar 106 is connected to a drive gear 107, which is driven to rotate by an external drive source. The waste toner chamber 105 incorporates a screw conveyor 143 that moves the waste toner, collected form the developing unit, into the waste toner chamber 105.

With the aforementioned toner cartridge, the agitating bar 106 in the fresh toner chamber 104 and the screw conveyor 143 need to be driven by separate drive sources. Driving the toner agitating bar 106 and screw conveyor 143 by separate drive sources makes the construction complicated and results in an increased number of parts.

SUMMARY OF THE INVENTION

The present invention was made to solve the problems of the aforementioned conventional art.

An object of the invention is to provide a toner cartridge of simple construction that requires a small number of parts.

A toner cartridge holds toner therein. A toner holding chamber holds toner therein. The toner holding chamber includes a first chamber and a second chamber. A partition wall divides the toner holding chamber into the first chamber and the second chamber. A toner moving member causes the toner in the first chamber to move. An agitating member agitates the toner in the second chamber. The toner moving member and the agitating member are operatively coupled so that when one of the toner moving member and the agitating member is driven in rotation, the other of the toner moving member and the agitating member also rotates.

The first chamber and the second chamber are aligned in a longitudinal direction of the toner cartridge.

The second chamber has a larger toner-holding capacity than the first chamber.

The toner moving member is a first screw conveyor. When the toner moving member is driven in rotation, the first screw conveyor causes the toner in the first chamber to move.

The first screw conveyor spans across substantially half a length of the first chamber.

The first chamber has a first opening through which waste toner is received from an external section into the first chamber. The second chamber has a second opening through which fresh toner is discharged from the second chamber, the second opening being located under the agitating member.

The agitating member is a toner agitating bar that agitates the toner in the second chamber when the agitating member is driven to rotate.

The agitating member has a second screw conveyor that causes the toner to move in the second chamber when the agitating member is driven to rotate.

The toner moving member and the agitating member are coupled through a coupling mechanism that extends through an opening formed in the partition wall. The partition wall has a leakage preventing structure that prevents the toner from leaking between the first chamber and the second chamber.

The leakage preventing structure includes a third screw conveyor formed on the toner moving member in the vicinity of the partition wall. When the partition wall includes a hollow cylinder that projects from the partition wall into the first chamber in such a way that at least a part of the third screw conveyor is rotatably received.

The first opening is formed in a first wall that opposes the partition wall. The toner moving member has a screw conveyor under the first opening.

The agitating member has an agitator bar. When the agitating member is rotated, the agitator bar agitates the toner in the second chamber and the second screw conveyor causes the toner in the first chamber to move.

The second chamber has a second wall that opposes the partition wall. The second screw conveyor is on a side close to the second wall and the agitator bar is on a side close to the partition wall.

A developing apparatus includes a toner cartridge attached to it. The developing apparatus includes a toner reservoir, a developing roller, and a toner supplying roller. The toner reservoir holds toner therein. The developing roller supplies the toner to a photoconductive drum. The toner supplying roller supplies the toner to the developing roller. The toner cartridge includes a toner holding chamber, a partition wall, a toner moving member, and an agitating member. The toner holding chamber holds toner therein and includes a first chamber and a second chamber. The first chamber has a first opening through which waste toner is received from an external section into the first chamber, and the second chamber has a second opening through which the toner is discharged from the second chamber. The second opening is located under the agitating member. The partition wall divides the toner holding chamber into the first chamber and the second chamber. The toner moving member causes the toner in the first chamber. The agitating member agitates the toner in the second chamber. The toner moving member and the agitating member are operatively coupled in such a way that when one of the toner moving member and the agitating member is driven in rotation, the other of the toner moving member and the agitating member also rotate. The toner moving member causes the toner in the first chamber to move and the toner in the second chamber is agitated by the agitating member and discharged into the developing apparatus through the second opening.

The combination of the aforementioned developing apparatus and a toner cartridge attached to the developing apparatus. The toner cartridge is detachably attached to the developing apparatus.

Further scope of applicability of the present invention will become apparent from the detailed description given hereinafter. However, it should be understood that the detailed description and specific examples, while indicating pre ferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

{General Construction}

Figure 1:
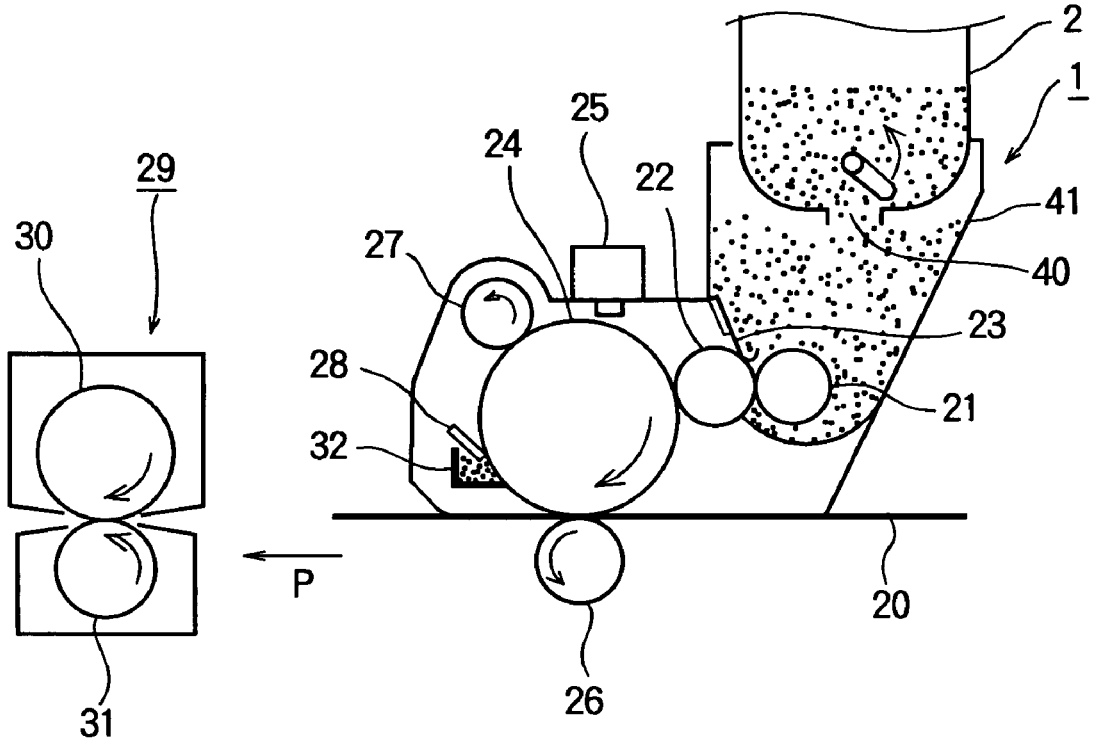
FIG. 1 is a schematic view of an image forming section to which a toner cartridge according to a first embodiment.

FIG. 1 is a schematic view of an image forming section of an image forming apparatus such as a printer. A toner cartridge 2 according to a first embodiment is attached to a developing unit 1 and toner is supplied through a toner exit 40. A charging roller 27 is driven by a drive source, not shown, to rotate in contact with a surface of a photoconductive drum 24, thereby charging the surface of the photoconductive drum 24 to a predetermined potential. An exposing unit 25 provided on the body of the printer illuminates the uniformly charged surface of the photoconductive drum 24 to form an electrostatic latent image in accordance with print data.

A toner cartridge 2 is detachably attached to a developing unit 1. Fresh, unused toner is supplied from the toner cartridge 2 into the developing unit 1. The developing unit 1 is detachably attached to the image forming apparatus. A toner-supplying roller 21 supplies the toner to a developing roller 22 while rotating. A developing blade 23 is in contact with the developing roller 22. When the developing roller 22 rotates, the developing blade 23 forms a thin layer of toner on the surface of the developing roller 22. As the developing roller 22 rotates in contact with the photoconductive drum 24, the toner layer is brought into contact with the electrostatic latent image so that the electrostatic latent image is developed into a toner image. When a recording medium 20 is fed from a paper cassette, not shown, and passes a transfer point defined between the photoconductive drum 24 and a transfer roller 26, the toner image is transferred onto the recording medium 20.

The recording medium 20 having the toner image on it is then transported in a direction shown by arrow P to a fixing unit 29. The fixing unit 29 includes fixing rollers 30 and 31 that incorporate a heat source, not shown. When the recording medium 20 passes a fixing point defined between the fixing rollers 30 and 31, the toner image on the recording medium 20 is subjected to heat and pressure so that the toner image is fused into a permanent image. The recording medium 20 is then discharged by a mechanism, not shown, to the outside of the image forming apparatus.

Figure 3:
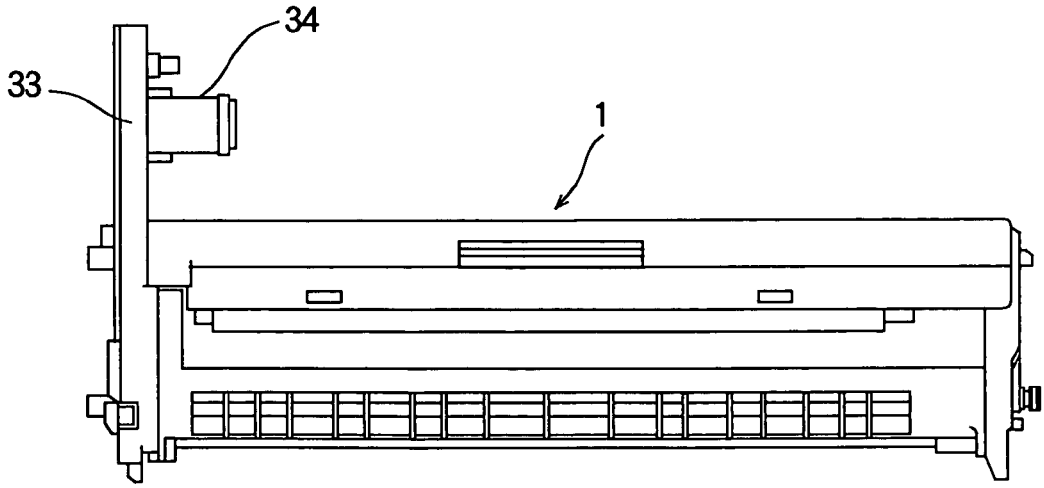
FIG. 3 is a front view of the developing unit.

Some of the toner on the photoconductive drum 24 fails to be transferred onto the recording medium 20, and remains as waste toner on the photoconductive drum 24. A cleaning blade 28 scrapes the residual toner from the photoconductive drum 24 and the scraped toner is received into a waste toner reservoir 32. The waste toner in the waste toner reservoir 32 is transferred by a transporting means, not shown, to a side wall 33 (FIG. 3). The waste toner arrives at the sidewall 33 and is transported by a transporting mechanism, not shown, incorporated in the side wall 33, to a waste toner exit 34. The waste toner is collected through the waste toner exit 34 into a waste toner chamber 5 (FIG. 5) of the toner cartridge 2 attached to the developing unit 1.

Figure 2:
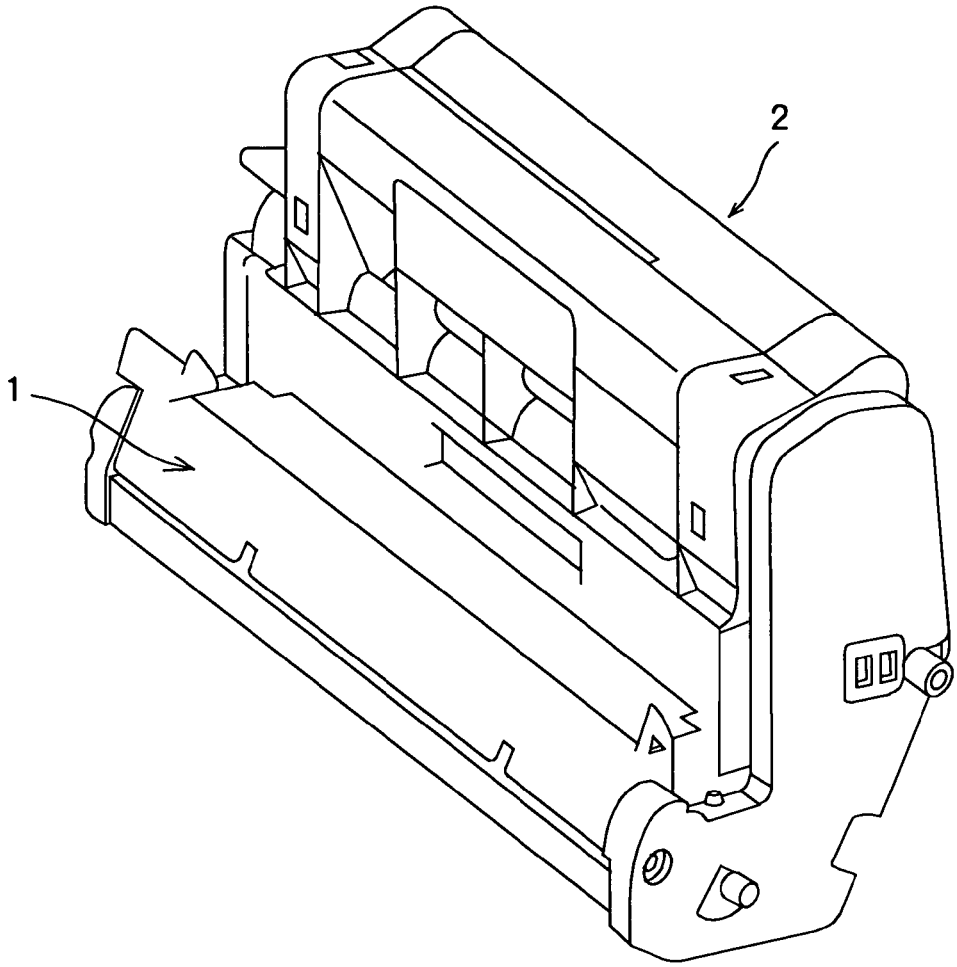
FIG. 2 is a perspective view of the toner cartridge attached to a developing unit.
Figure 4:
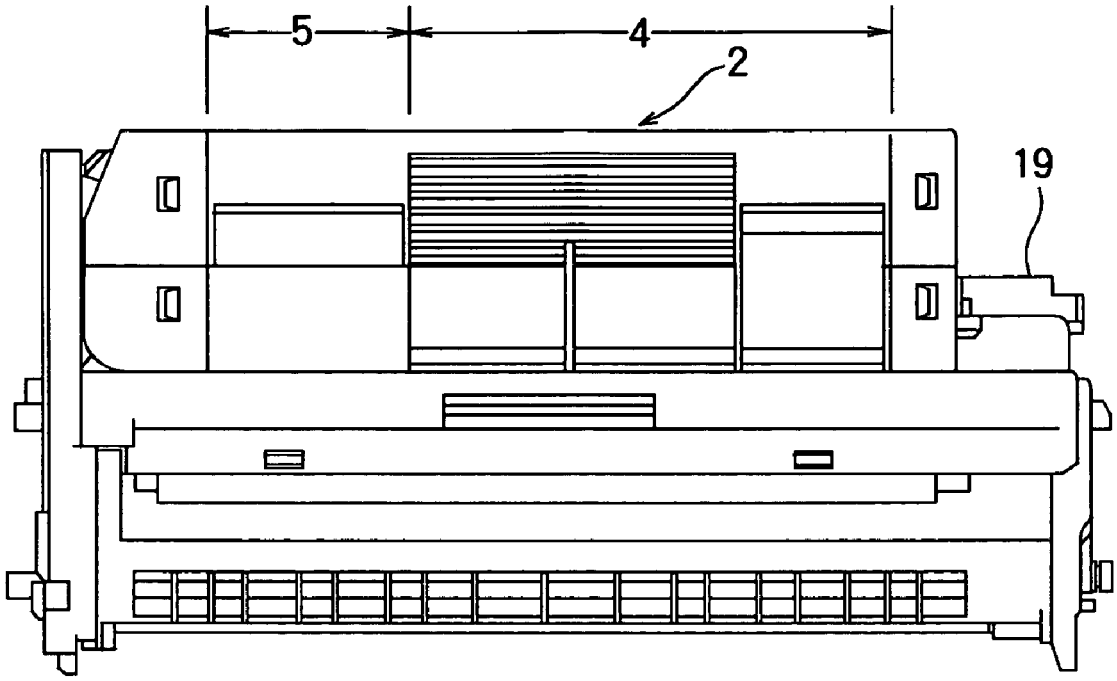
FIG. 4 is a front view of the toner cartridge attached to the developing unit.

FIG. 2 is a perspective view of the toner cartridge 2 attached to the developing unit 1. FIG. 3 is a front view of the developing unit 1. FIG. 4 is a front view of the toner cartridge 2 attached to the developing unit 1.

{Detaching the Toner Cartridge}

Figure 5:
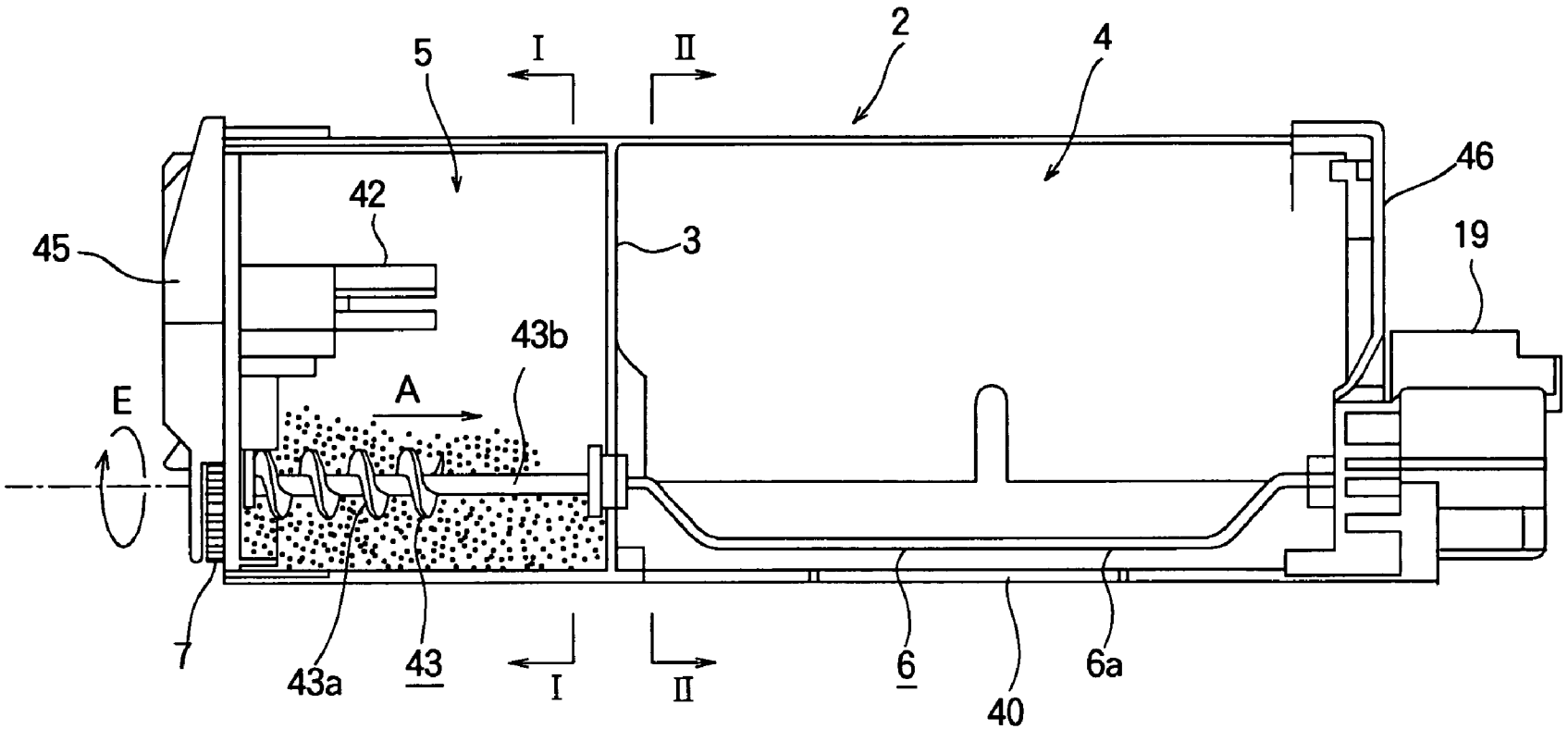
FIG. 5 is a side cross-sectional view illustrating the details of the toner cartridge according to the first embodiment.

A description will be given of the operation where the toner cartridge 2 is detached for replacement. A toner level sensor, not shown, monitors the toner level in a fresh toner chamber 4 (FIG. 5). The image forming apparatus indicates when the toner level reaches a predetermined value. The user operates a lever 19 to close the toner exit 40 and cause the toner cartridge 2 to disengage from the developing unit 1. Then, the user detaches the toner cartridge 2. At this moment, the amount of waste toner held in the waste toner chamber 5 may be large or may be small, depending on the type of printing performed up to that time.

{Attaching the Toner Cartridge}

A description will be given of the operation where the toner cartridge 2 is attached to the developing unit 1. The toner cartridge 2 is attached to the developing unit 1 in such a way that the toner cartridge 2 and the developing unit 1 communicate with each other through a waste toner inlet 42 (FIG. 5) and the waste toner exit 34 formed in the side wall 33 (FIG. 3) of the developing unit 1, thereby completely attaching the toner cartridge 2 to the developing unit 1.

Then, when the operator rotates the lever 19, an engagement portion, not shown, of the toner cartridge 2 engages an engagement portion of the developing unit 1 and a drive gear 7 (FIG. 5) moves into meshing engagement with the driving mechanism on the developing unit 1 side.

The toner exit 40 formed in the bottom of the toner cartridge 2 is operatively associated with the lever 19, so that when the user operates the lever 19, the fresh toner falls from the fresh toner chamber 4 into the developing unit 1 (FIG. 1). The toner exit 40 extends substantially across the full longitudinal length of the fresh toner chamber 4. After the toner cartridge 2 has been attached to the developing unit 1, the toner supplying roller 21 is driven in rotation by a drive source (not shown) provided on the body of the image forming apparatus. The toner in a toner reservoir 41 of the developing unit 1 is supplied to the surface of the developing roller 22 that is being rotated by a drive source, not shown.

{Detailed Construction of Toner Cartridge}

Figure 6:
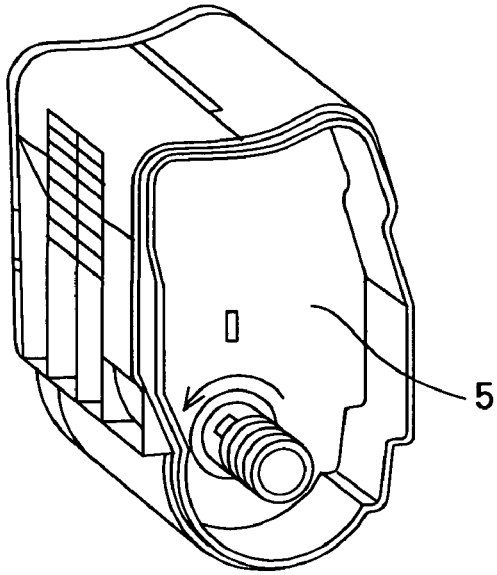
FIG. 6 is a fragmentary perspective view with a cross-section taken along line I-I of FIG. 5.
Figure 7:
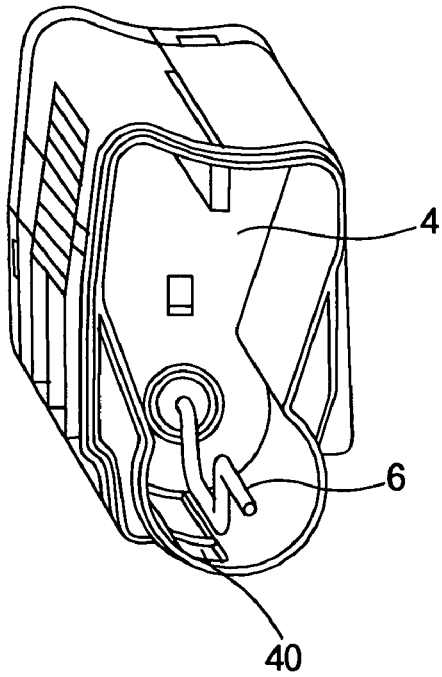
FIG. 7 is a fragmentary perspective view with a cross-section taken along line II-II of FIG. 5.

FIG. 5 is a cross-sectional side view illustrating the details of the toner cartridge 2 according to the first embodiment. FIG. 6 is a fragmentary perspective view with a cross-section taken along line I-I of FIG. 5. FIG. 7 is a fragmentary perspective view with a cross-section taken along line II-II of FIG. 5. FIGS. 6 and 7 illustrate pertinent portions of the toner cartridge 2 without details.

The toner cartridge 2 is a hollow body extending in a longitudinal direction, and includes the fresh toner chamber 4 and the waste toner chamber 5 divided by a partition wall 3. The fresh toner chamber 4 has a larger toner-holding capacity than the waste toner chamber 5. A lid 45 closes one longitudinal end of the toner chamber 2. The lid 45 incorporates a drive mechanism that drives a later described screw conveyor 43 and an agitator bar 6. This drive mechanism is driven by an external drive source. Another lid 46 closes another longitudinal end of the toner cartridge 2, and has the lever 19 that is operated by the user to open and close the toner exit 40.

There is a screw conveyor 43 in the waste toner chamber 5. The screw conveyor 43 includes a longitudinally extending shaft 43*b* and a blade 43*a* that spirals around the shaft 43*b*. The screw conveyor 43 is rotatably supported. There is provided the waste toner inlet 42 above the screw conveyor 43. The agitator bar 6 has a crank 6*a* and extends in a longitudinal direction. The agitator bar 6 is rotatable about the longitudinal direction. The shaft 43*b* of the screw conveyor 43 has a large diameter portion 100*a* and the shaft 6*b* of the agitator bar 6 has a large diameter portion 100*b*. The shaft 43*b* and shaft 6*b* are coupled to each other through the large-diameter portions 100*a* and 100*b*, which are rotatably fitted into the partition wall 3. When an external drive source, not shown, drives a drive gear 7 to rotate, the screw conveyor 43 rotates in a direction shown by arrow E and the crank 6*a* rotates to agitate the fresh toner in the fresh toner chamber 4. The toner in the fresh toner chamber 4 is discharged through the toner exit 40 formed in the bottom of the fresh toner chamber 4.

The waste toner entered into the waste toner chamber 5 falls onto the screw conveyor 43. When the screw conveyor 43 rotates in the E direction, the toner is carried on the screw conveyor 43, while being dispersed little by little. One end of the shaft 6*b* of the agitator bar 6 is coupled to the shaft 43*b* of the screw conveyor 43 in such a way that the two shafts 6*b* and 43*b* are in line with each other. Another end of the shaft 6*b* of the agitator bar 6 is rotatably supported by the lid 46 that opposes the partition wall 3.

The screw conveyor 43 and agitator bar 6 are required to have a certain mechanical strength, and thus, are made of ABS resin. Highly rigid ABS resin containing a glass fiber is highly desirable. The spiral blade 43*a* of the screw conveyor 43 according to the embodiment has a diameter and a pitch, which are about 10 mm, but are not limited to these values. The diameter and pitch may be of any values provided that the rotation of the spiral can disperse and move the waste toner in the waste toner chamber 5. In order that the collected waste toner is moved to the middle portion of the waste toner chamber 5, the spiral extends over only half the full length of the waste toner chamber 5. The aforementioned requirements may be modified as required.

{Coupling mechanism}

Figure 8:
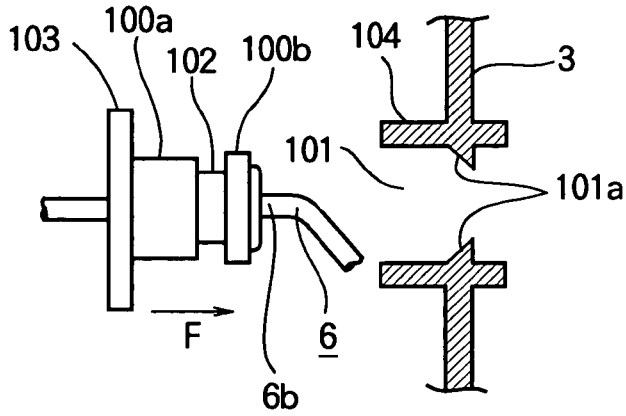
FIG. 8 illustrates the large-diameter portions before they are assembled in a direction shown by arrow F into a hole formed in a partition wall.
Figure 9:
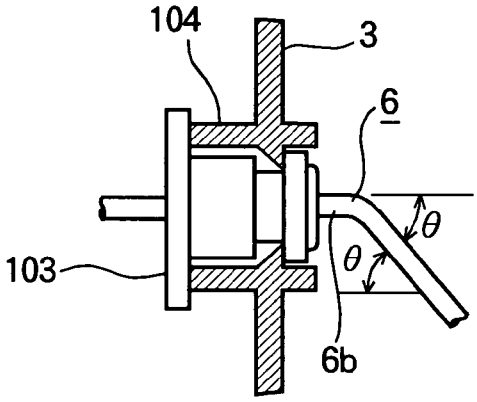
FIG. 9 illustrates the large-diameter portions after the large-diameter portions are pushed into the hole.

The partition wall 3 and the agitator bar 6 will be described. FIG. 8 illustrates the large-diameter portions 100*a* and 100*b* before they are assembled in a direction shown by arrow F into a hole 101 formed in the partition wall 3. FIG. 9 illustrates the large diameter portions 100*a* and 100*b* after the large diameter portions 100*a* and 100*b* are pushed into the hole 101. When the agitator bar 6 is pushed into the hole 101, an annular projection 101*a* that defines the hole 101 deforms, allowing the large-diameter portions 100*a* and 100*b* to enter the hole 101. As shown in FIG. 9, the large-diameter portions 100*a* and 100*b* slide on a beveled surface of the annular projection 101*a* into the hole 101 so that a small-diameter portion 102 fits into the hole 101 formed between the large-diameter portions 100*a* and 100*b*. Thus, the agitator bar 6 and the screw conveyor 43 are rotatably supported. The partition wall 3 has a hollow cylinder portion 104 that extends toward the interior of the waste toner chamber 5. There is formed a disk-like stopper 103 adjacent to the large diameter portion 100*a*. The disk-like stopper 103 is concentric to the shaft 43*b* of the screw conveyor 43. The cylinder portion 104 has a smaller outer diameter than the disk-like stopper 103, and therefore abuts the disk-like stopper 103. The wall of the cylinder 104 is normal to the disk-like stopper 103. The ring shaped annular projection 101*a* has a surface normal to the direction in which the large-diameter portion 100*b* enters the partition wall 3. Thus, the annular projection 101*a* serves as a stopper against the large diameter portion 100*b*, preventing the large-diameter portion 100*b* from moving into the waste toner chamber 5.

Figure 10:
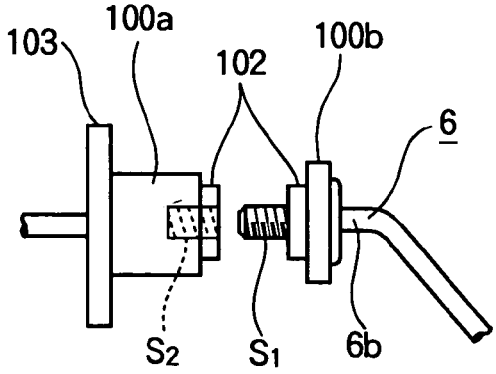
FIG. 10 illustrates the details of the structure of the large-diameter portion.

FIG. 10 illustrates the details of the structure of the large diameter portion. The screw conveyor 43 and the agitator bar 6 in FIGS. 8 and 9 are coupled together by means of a screw, i.e., mechanical coupling. Specifically, the shaft 6*b* of the agitator bar 6 has a male screw S1 and the large-diameter portion 100*a* has a female screw S2. The screw conveyor 43 is rotated relative to the large-diameter portion 100*a*, thereby being fitted into the hole 101. The male screw is rotated into the female screw in such a direction that when the screw conveyor 43 is rotated, the male screw remains firmly screwed into the female screw.

The agitator bar 6 of the fresh toner chamber 4 will now be described. The crank 6*a* should spans over the substantially full length of the fresh toner exit 40 while also being prevented from colliding with the inner wall of the fresh toner chamber 4. The crank 6*a* should extend substantially across the full length of the toner exit 40. Further, the agitator bar 6 should be bent at angle θ to form the crank 6*a* so that the agitator bar 6 can extend into the partition wall 3 through the hole formed in the partition wall 3. Taking the aforementioned requirements into account, the angle θ is selected to be 60° in the embodiment. The agitator bar 6 may be any shapes provided that the toner in the fresh toner chamber 4 is properly agitated and discharged through the toner exit 40.

{Operation}

The apparatus according to the first embodiment operates as follows: The waste toner collecting mechanism, not shown, collects the waste toner resulting from failure of transfer of part of toner images, and transports the waste toner to the waste toner chamber 5. A drive source is provided on the developing unit side and is coupled to the drive gear 7. The drive source drives the drive gear 7 to rotate so that the drive gear 7 drives the screw conveyor 43 coupled to the drive gear 7 to rotate. The waste toner enters the waste toner chamber 5 through the waste toner inlet 42 and falls onto the screw conveyor 43. The screw conveyor 43 moves the waste toner toward the back end portion of the waste chamber 5 while dispersing the waste toner. In this manner, the waste toner is collected into the waste toner chamber 5. At this moment, because the screw conveyor 43 and the agitator 6 are coupled operatively, the agitator 6 also rotates. The fresh toner in the fresh toner chamber 4 continues to be supplied into the toner reservoir 41, while being agitated by the agitator bar 6.

When the screw conveyor 43 causes the waste toner to move in the waste toner chamber 5, the toner exerts a force on the screw conveyor 43 acting to push back in a direction opposite to arrow A in FIG. 5. However, the large-diameter portion 100*b* abuts an annular projection 101*a* on the partition wall 3 to prevent the screw conveyor 43 and the agitator bar 6 from moving in their longitudinal directions, ensuring stable rotation of the screw conveyor 43.

As described above, the toner cartridge 2 according to the first embodiment is designed to perform two modes of operations simultaneously. First, the toner is supplied into the developing unit 1 while being agitated by the crank 6*a*. Second, the toner is dispersed and moved in the waste toner chamber 5. It is only necessary to drive the screw conveyor 43 in rotation from outside, requiring a minimum number of structural elements. The agitator in the fresh toner chamber 4 does not have to be driven by a drive source separate from the screw conveyor in the waste toner chamber 5, so that the fresh toner holding space can be large to accommodate a large amount of fresh toner.

Second Embodiment

Figure 11:
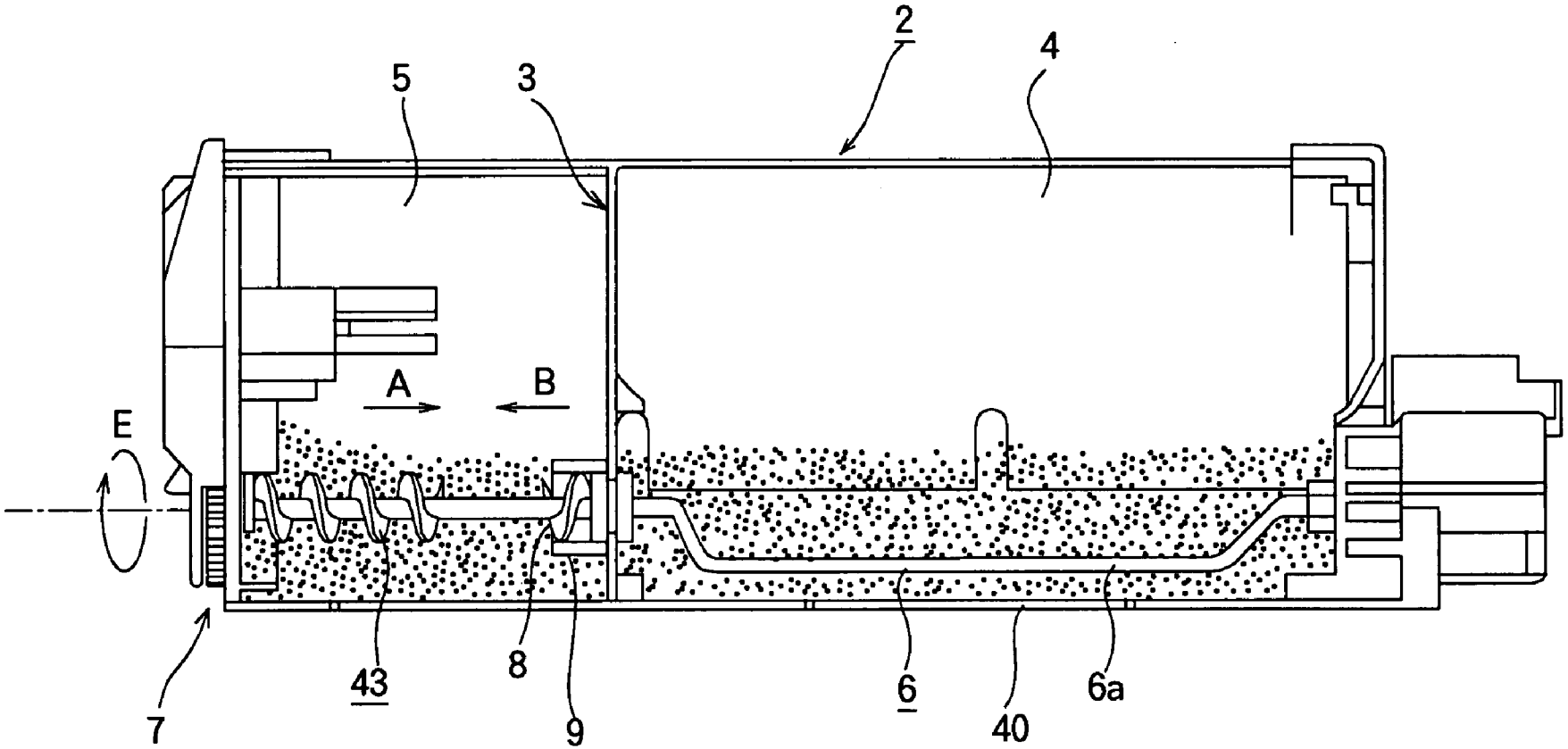
FIG. 11 illustrates a toner cartridge according to a second embodiment.

FIG. 11 illustrates a toner cartridge 2 according to a second embodiment. The second embodiment differs from the first embodiment in that a screw conveyor 43 has a reverse screw conveyor 8.

The waste toner is received in the waste toner chamber 5 through a waste toner inlet 42, and the screw conveyor 43 moves the waste toner toward the middle of the waste toner chamber 5 while dispersing the waste toner. However, an increase in the amount of waste toner gives rise to a possibility that the waste toner moving in the A direction leaks into the fresh toner chamber 4 through a hole 101 formed in a partition wall 3. In order to prevent the leakage of the waste toner into the fresh toner chamber 4, the toner cartridge according to the second embodiment has the reverse screw conveyor 8 that has a blade 8*a* that spirals in the opposite direction to the screw conveyor 43. Therefore, when the shaft 43*b* of the screw conveyor 43 is rotated in a direction shown by arrow E, the screw conveyor 43 causes the waste toner to move in a direction shown by arrow A and the reverse screw conveyor 8 causes the waste toner to move in a direction shown by arrow B.

The reverse screw conveyor 8 causes the waste toner to move in a direction shown by arrow B opposite to the A direction, thereby preventing the waste toner from entering the hole 101. However, as the amount of waste toner in the waste toner chamber 5 increases, the reverse screw conveyor 8 is not enough to completely prevent the waste toner from entering the hole 101. Thus, to prevent further leakage of the waste toner into the fresh toner chamber 4, the reverse screw conveyor 8 cooperates with a hollow cylinder 9 that projects from the partition wall 3. The hollow cylinder 9 has an inner diameter somewhat larger than that of the reverse screw conveyor 8. The hollow cylinder 9 loosely fits over the reverse screw conveyor 8, allowing the reverse screw conveyor 8 to rotate in the cylinder 9. The cylinder 9 is somewhat shorter than the reverse screw conveyor 8, so that the reverse screw conveyor 8 effectively causes the waste toner to move out of the hollow cylinder 9. The hollow cylinder 9 is preferably made in one piece with the partition wall 3.

When the drive gear 7 is driven to rotate in the E direction, the fresh toner in the fresh toner chamber 4 is agitated by the agitator bar 6 and is discharged through the toner exit 40 into a developing unit 1. After transfer of toner images, a toner-collecting mechanism, not shown, collects residual toner into the waste toner chamber 5 of the toner cartridge 2. The screw conveyor 43 and the agitator bar 6 are coupled together by means of a mechanism, for example, that shown in FIG. 10.

As described above, the second embodiment has both the reverse spiral 8 and the screw conveyor 43, and the reverse screw conveyor 8 is loosely fitted into the hollow cylinder 9, thereby further ensuring that the waste toner does not enter into the fresh toner chamber 4. An advantage of the second embodiment is that the configuration does not require any special sealing member. The provision of the reverse screw conveyor 8 prevents an excessive amount of waste toner from entering the hole 101 formed in the partition wall 3, thereby decreasing the mechanical load on the rotating agitator bar 6. Because the load on the agitator bar 6 is reduced, the agitator bar 6 may be made of a non-metal, light, and inexpensive material such as ABS resin.

When the screw conveyor 43 rotates to move the waste toner in the waste toner chamber 5, the waste toner exerts a force on the screw conveyor 43 in the opposite direction to the A direction. However, the large-diameter portion 100*b* abuts the annular projection 101*a* of the partition wall 3 serving as a stopper, so that the screw conveyor 43 and agitator bar 6 are prevented from moving in their longitudinal directions. Therefore, this ensures stable, reliable rotation of the screw conveyor 43.

Third Embodiment

Figure 12:
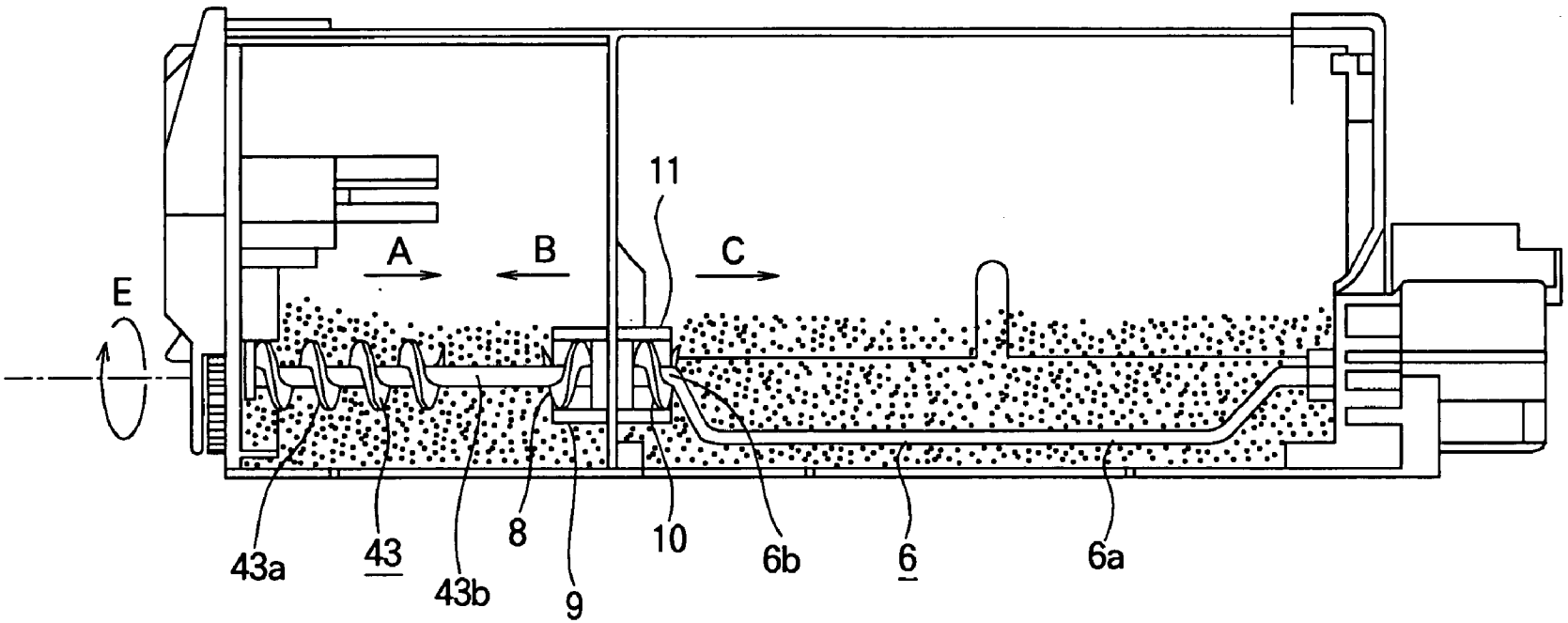
FIG. 12 illustrates a toner cartridge according to a third embodiment.

FIG. 12 illustrates a toner cartridge according to a third embodiment. The third embodiment further improves the shapes of an agitator bar 6 and a partition wall 3 according to the second embodiment. In other words, an agitator bar 6 has a shaft 6*b* rotatably supported by a partition wall 3. The agitator 6 has a blade attached to a part of the shaft 6*b*, the blade describing a spiral about the shaft 6*b* to form a screw conveyor 10. The partition wall 3 has a hollow cylinder 11 that extends toward the middle portion of the fresh toner chamber 4. The shaft 43*b* of the screw conveyor 43 and the shaft 6*b* of the agitator bar 6 are in line with each other and are coupled through the same mechanism as that in FIGS. 8-10. The hollow cylinder 11 has an inner diameter larger than an outer diameter of the screw conveyor 10, so that the hollow cylinder 11 receives the screw conveyor 10 therein and the screw conveyor 10 is rotatable relative to the hollow cylinder 11. The hollow cylinder 11 is shorter than the screw conveyor 10 to ensure that the screw conveyor 10 pushes the fresh toner completely out of the hollow cylinder 11 in a direction shown by arrow C. This prevents the fresh toner from leaking into the waste toner chamber 5.

When an external drive source drives a drive gear 7 to rotate in a direction shown by arrow E, the drive gear 7 drives the screw conveyor 10 and the agitator bar 6 in rotation. Thus, the crank 6*a* of the agitator bar 6 agitates the fresh toner in the fresh toner chamber 4, the fresh toner being discharged into a developing unit 1 through a toner exit 40 formed in a bottom of the fresh toner chamber 4.

A toner collecting mechanism, not shown, collects the waste toner resulting from the transfer of toner images into the waste toner chamber 5 through a waste toner inlet 42. The rotation of the drive gear 7 causes the screw conveyor 43 to rotate, so that the spiral blade 43*a* of the screw conveyor 43 pushes the waste toner toward the partition wall 3 while dispersing the waste toner. The shaft 43*b* of the screw conveyor 43 has another spiral blade 8*a* that describes a spiral in the opposite direction to the screw conveyor 43. The spiral blade 8*a* on the shaft 43*b* forms a reverse screw conveyor 8. The reverse screw conveyor 8 and the screw conveyor 43 cause the waste toner to move in the opposite directions, thereby preventing the waste toner from entering the fresh toner chamber 4 through gaps between the coupling mechanism in FIG. 8-10 and the partition wall 3.

When the screw conveyor 43 causes the waste toner to move in the A direction while agitating the waste toner, the waste toner exerts a force on the blade 43*a* of the screw conveyor 43, the force acting in the B direction. At this moment, a large diameter portion 100*b* abuts the annular projection 101*a* of the partition wall 3, serving as a stopper, so that the screw conveyor 43 and agitator bar 6 cannot move in the longitudinal direction of the toner cartridge.

As described above, the screw conveyor 10 mounted to the agitator bar 6 cooperates with the hollow cylinder 11 to prevent the fresh toner from entering the waste toner chamber 5.

Fourth Embodiment

Figure 13:
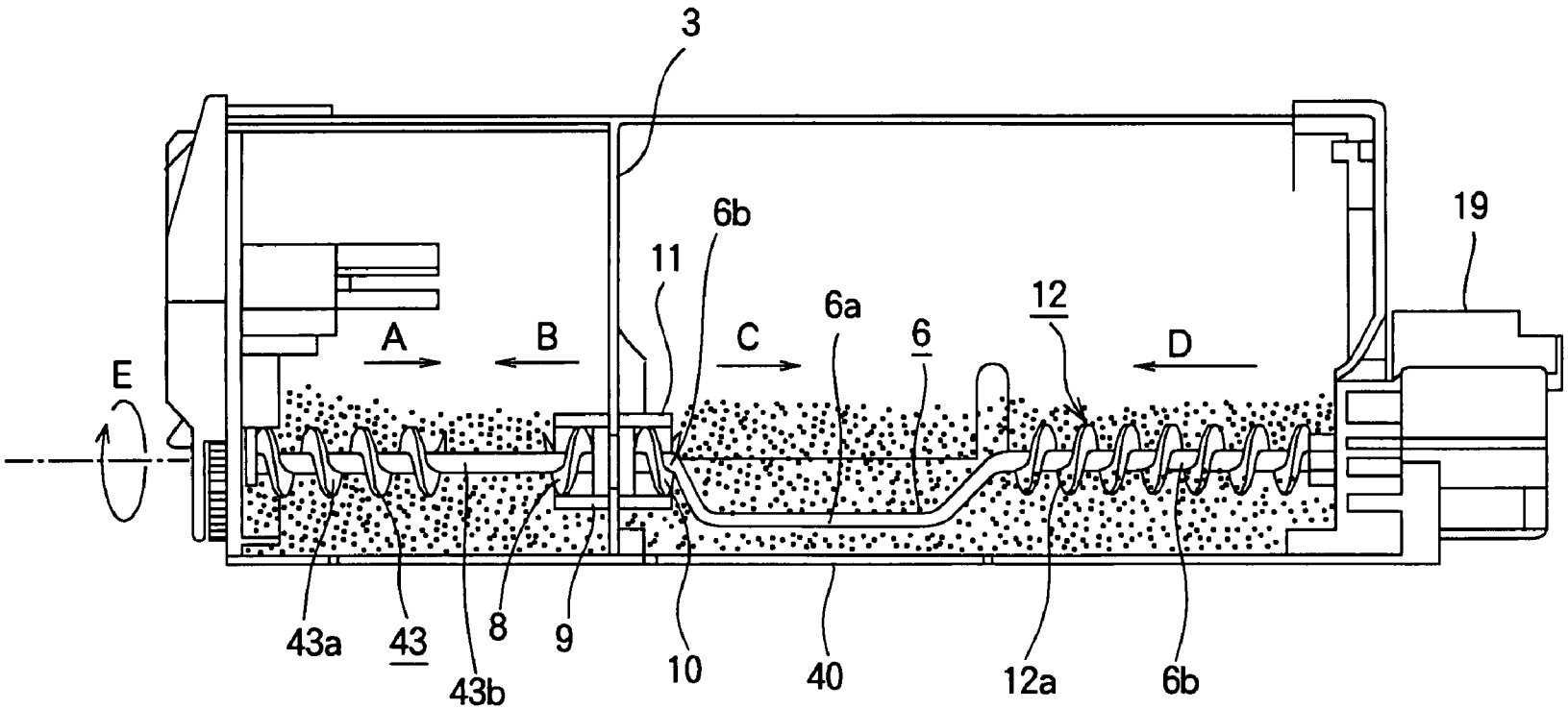
FIG. 13 is a side cross-sectional view of a toner cartridge according to a fourth embodiment.
Figure 14:
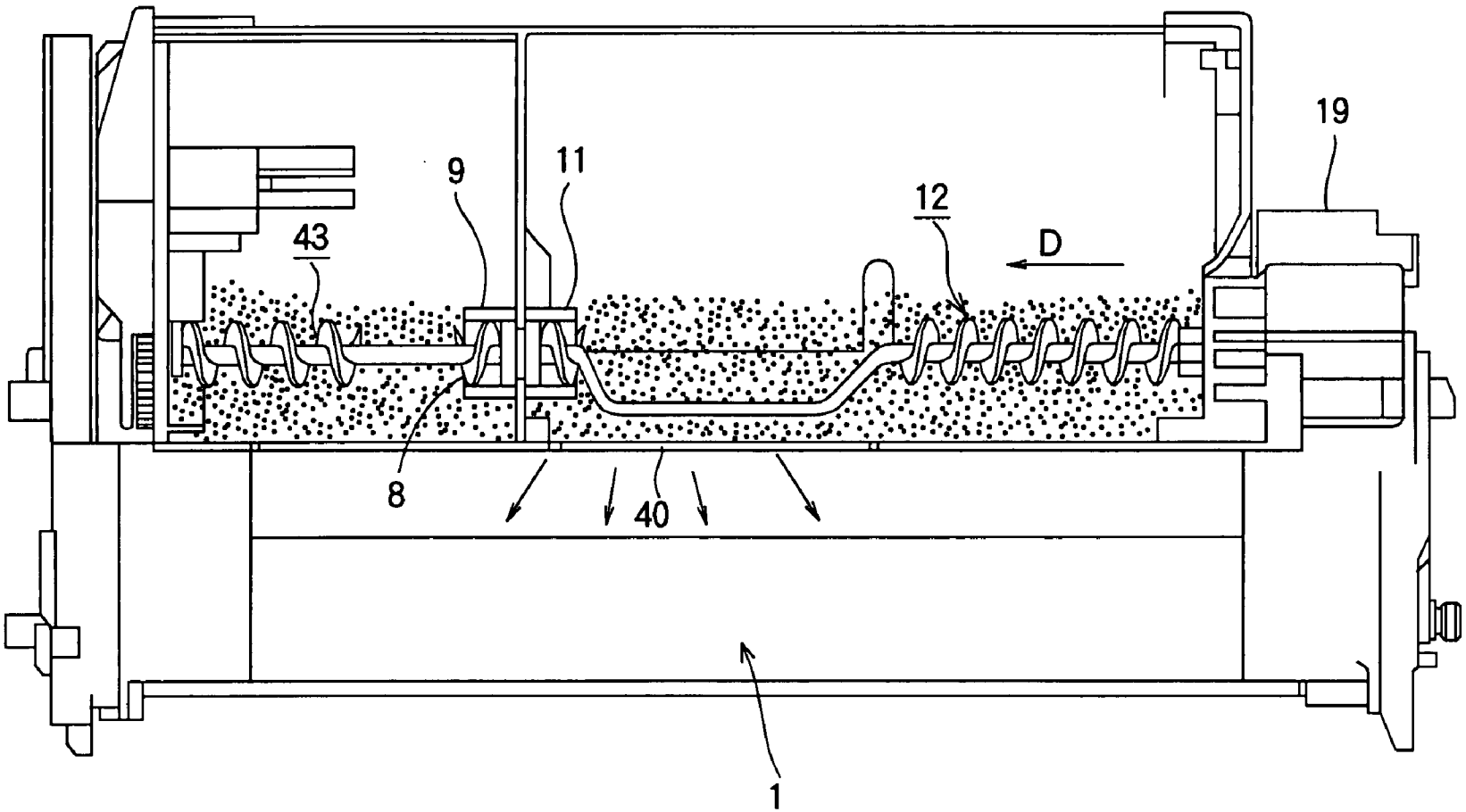
FIG. 14 illustrates the toner cartridge of FIG. 13, attached to a developing unit.
Figure 15:
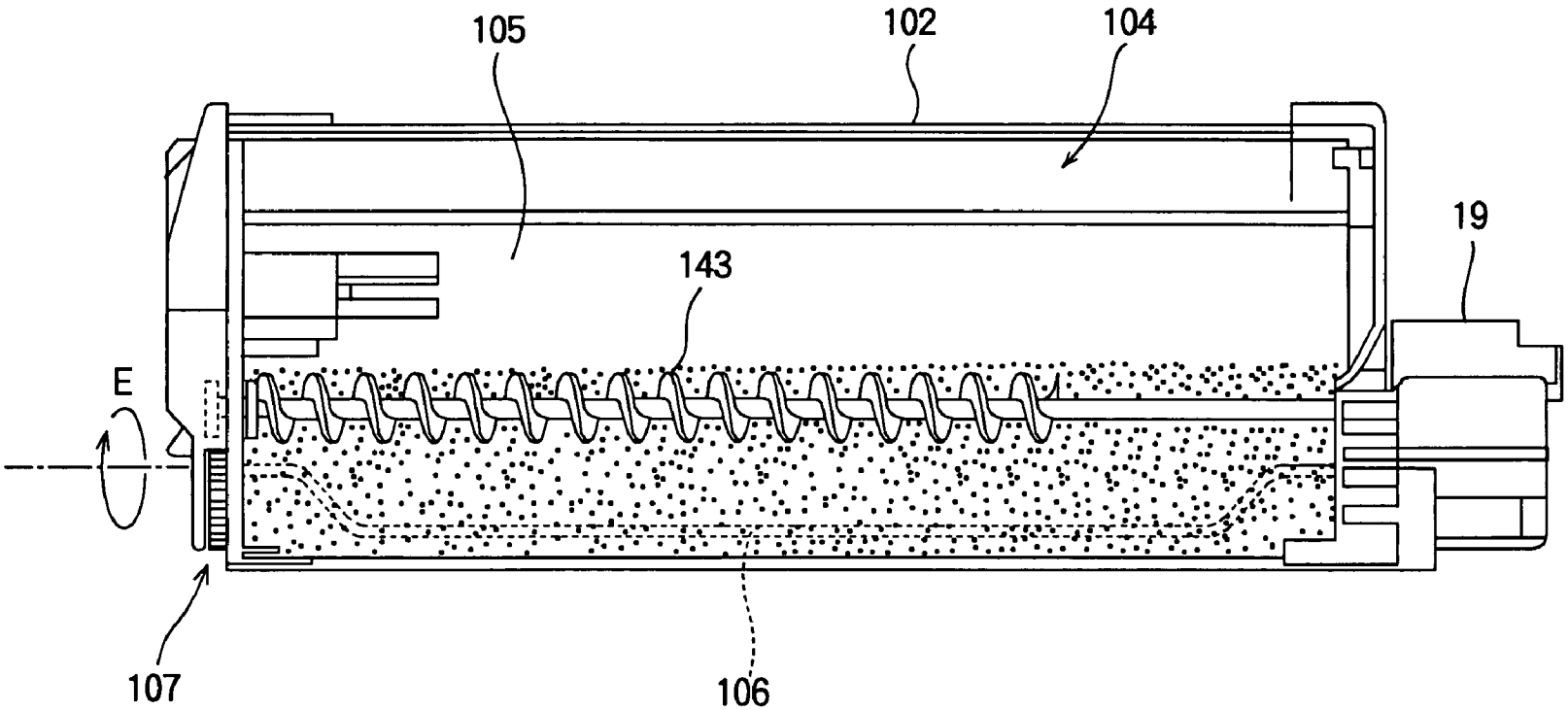
FIG.15 CONVENTIONAL ART
FIG. 15 is a side cross-sectional view of a waste toner chamber of a conventional toner cartridge for use in an electrophotographic printer.
Figure 16:
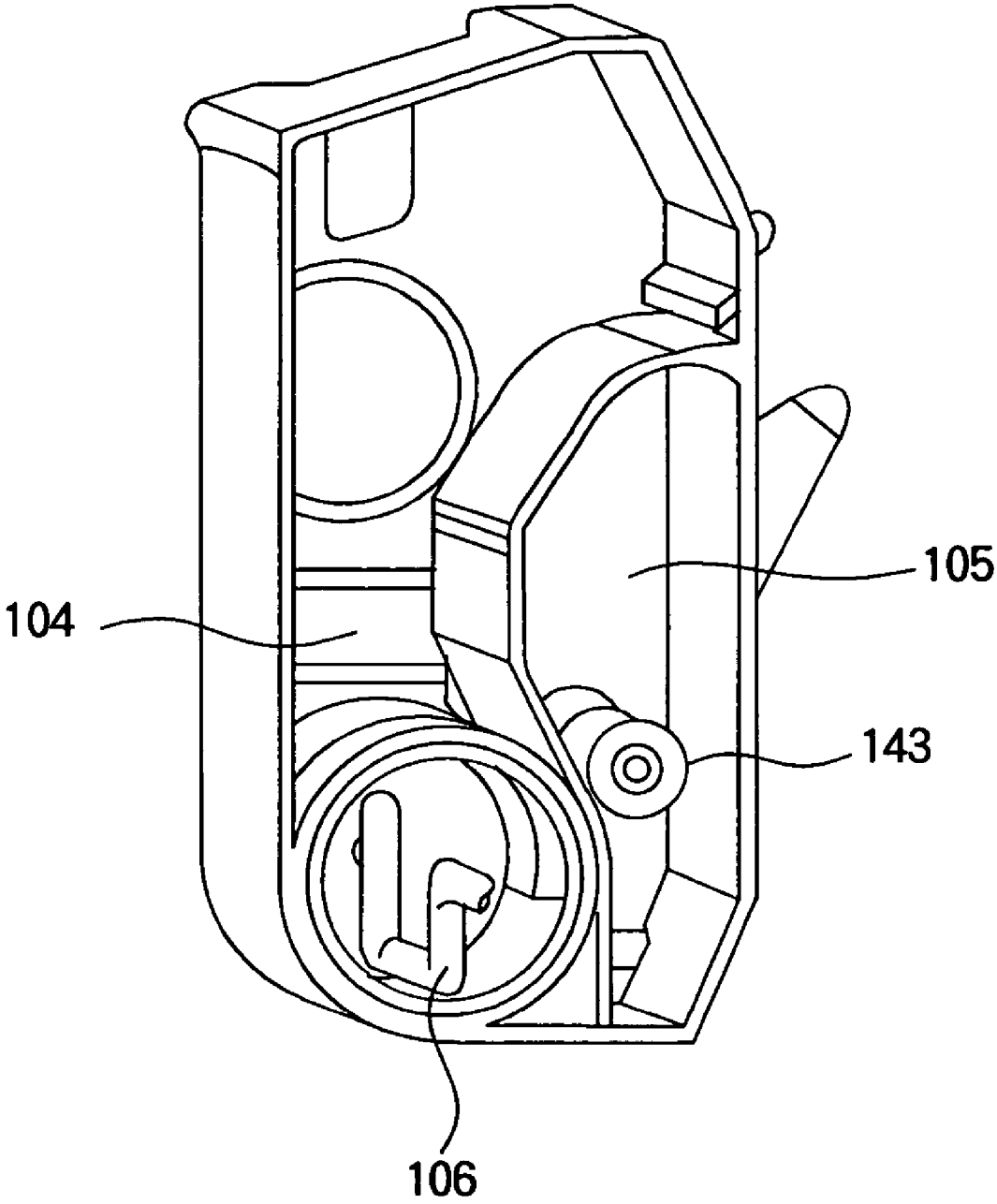
FIG.16 CONVENTIONAL ART
FIG. 16 is a perspective view of a lid mounted to close one end of the conventional toner cartridge that extends in a longitudinal direction.

A fourth embodiment is directed to an improvement of the shape of the agitator bar 6 according to the third embodiment. FIG. 13 is a cross-sectional side view of a toner cartridge 2 according to the fourth embodiment. FIG. 14 illustrates the toner cartridge 2 attached to a developing unit 1. The agitator bar 6 has a shorter crank 6*c* than the third embodiment. The agitator bar 6 has a screw conveyor 10 and a reverse screw conveyor 12 having a blade 12*a* that describes a spiral around a shaft 6*b* in a direction opposite to the screw conveyor 10. A shaft 43*b* of the screw conveyor 43 and a shaft 6*b* of the agitator bar 6 are in line with each other and are coupled through the same mechanism as that in FIGS. 8-10.

When an external drive source, not shown, drives a drive gear 7 to rotate in a direction shown by arrow E, the screw conveyor 43 rotates to move waste toner toward a partition wall 3 while dispersing the waste toner. The agitator bar 6 also rotates to agitate fresh toner in a fresh toner chamber 4. Because the reverse screw conveyor 12 rotates to move the fresh toner toward a toner exit 40, the fresh toner is supplied more evenly across the longitudinal length of the developing unit 1. The fresh toner is discharged from the fresh toner chamber 4 into the developing unit 1 through the toner exit 40.

As opposed to the first to third embodiments, the toner exit 40 extends across substantially ⅔ of the longitudinal length of the fresh toner chamber 4 and therefore there is a tendency of the supply of fresh toner to be uneven across the length of the developing unit 1. The reverse screw conveyor 12 spans substantially half the length of the fresh toner chamber 4 and moves the fresh toner toward the partition wall 3 in a direction shown by arrow D, the fresh toner being supplied into the developing unit 1 through the toner exit 40 formed substantially in the longitudinally middle portion of the fresh toner chamber 4.

When the screw conveyor 43 rotates, the waste toner exerts a force on the blade 43*a* of the screw conveyor 43, acting in a direction shown by arrow A. The large-diameter portion 100*b* abuts the annular projection 101*a* that serves as a stopper, so that the screw conveyor 43 and the agitator bar 6 are prevented from moving in their longitudinal directions. This ensures stable, reliable rotation of the screw conveyor 43.

As described above, according to the fourth embodiment, the fresh toner is prevented from being distributed unevenly across the longitudinal direction of the developing unit 1, and the fresh toner is consumed efficiently in the developing unit 1. The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner cartridge comprising:

a toner holding chamber that holds toner therein, said toner holding chamber including a first chamber and a second chamber;

a partition wall that divides said toner holding chamber into the first chamber and the second chamber;

a toner moving member that causes the toner in the first chamber to move; and an agitating member that agitates the toner in the second chamber, wherein said toner moving member and said agitating member are operatively coupled so that when one of said toner moving member and said agitating member is driven in rotation, the other of said toner moving member and said agitating member also rotates, and wherein said toner moving member and said agitating member are coupled through a coupling mechanism that extends through an opening formed in the partition wall, said partition wall has a leakage preventing structure that prevents the toner from leaking between the first chamber and the second chamber.

2. The toner cartridge according to claim 1, wherein the first chamber and the second chamber are aligned in a longitudinal direction of the toner cartridge.

3. The toner cartridge according to claim 1, wherein the second chamber has a larger toner-holding capacity than the first chamber.

4. The toner cartridge according to claim 1, wherein said toner moving member is a screw conveyor, and wherein when said toner moving member is driven in rotation, the first screw conveyor causes the toner in the first chamber to move.

5. The toner cartridge according to claim 4, wherein the screw conveyor spans across substantially half a length of the first chamber.

6. The toner cartridge according to claim 1, wherein the first chamber has a first opening through which toner is received from an external section into the first chamber, and the second chamber has a second opening through which the toner is discharged from the second chamber, the second opening being located under said agitating member.

7. The toner cartridge according to claim 6, wherein the first opening is formed in a first wall that opposes said partition wall;

wherein said toner moving member has a screw conveyor under the first opening.

8. The toner cartridge according to claim 1, wherein said agitating member is a toner agitating bar that agitates the toner in the second chamber when said agitating member is driven to rotate.

9. The toner cartridge according to claim 1, wherein the leakage preventing structure includes a screw conveyor formed on said toner moving member in the vicinity of said partition wall;

wherein the partition wall includes a hollow cylinder that projects from said partition wall into the first chamber in such a way that at least a part of the third screw conveyor is rotatably received.

10. A developing apparatus incorporating said toner cartridge according to claim 1, further comprising:

a toner reservoir that holds toner therein;

a developing roller that supplies the toner to a photoconductive drum; and a toner supplying roller that supplies the toner to said developing roller.

11. The developing apparatus according to claim 10, wherein said toner cartridge is detachably attached to the developing apparatus.

12. An image forming apparatus incorporating said toner cartridge according to claim 1, comprising a developing apparatus.

13. The image forming apparatus according to claim 12, wherein said developing apparatus is detachably attached to the image forming apparatus.

14. A toner cartridge comprising:

a toner holding chamber that holds toner therein, said toner holding chamber including a first chamber and a second chamber;

a partition wall that divides said toner holding chamber into the first chamber and the second chamber;

a toner moving member that causes the toner in the first chamber to move;

an agitating member that agitates the toner in the second chamber, wherein said toner moving member and said agitating member are operatively coupled so that when one of said toner moving member and said agitating member is driven in rotation, the other of said toner moving member and said agitating member also rotates, wherein said agitating member has an agitator bar, and wherein when said agitating member is rotated, the agitator bar agitates the toner in the second chamber and the toner moving member causes the toner in the first chamber to move.

15. The toner cartridge according to claim 14, wherein the second chamber has a second wall that opposes said partition wall;

wherein the toner moving member is on a side close to the second wall and the agitator bar is on a side close to said partition wall.

16. The toner cartridge according to claim 14, wherein the first chamber and the second chamber are aligned in a longitudinal direction of the toner cartridge.

17. The toner cartridge according to claim 14, wherein the second chamber has a larger toner-holding capacity than the first chamber.

18. The toner cartridge according to claim 14, wherein said toner moving member is the screw conveyor, and wherein when said toner moving member is driven in rotation, the first screw conveyor causes the toner in the first chamber to move.

19. The toner cartridge according to claim 18, wherein the screw conveyor spans across substantially half a length of the first chamber.

20. The toner cartridge according to claim 14, wherein the first chamber has a first opening through which toner is received from an external section into the first chamber, and the second chamber has a second opening through which the toner is discharged from the second chamber, the second opening being located under said agitating member.

21. The toner cartridge according to claim 20, wherein the first opening is formed in a first wall that opposes said partition wall, and wherein said toner moving member has a screw conveyor under the first opening.

22. The toner cartridge according to claim 14, wherein said agitating member is a toner agitating bar that agitates the toner in the second chamber when said agitating member is driven to rotate.

* * * * *